US006419088B1

(12) United States Patent
Barrois et al.

(10) Patent No.: US 6,419,088 B1
(45) Date of Patent: Jul. 16, 2002

(54) DEVICE FOR TRANSPORTING FRAGILE OBJECTS, AND IN PARTICULAR BLOOD BAGS

(75) Inventors: Damien Barrois; Alain Laprie, both of Bordeaux (FR)

(73) Assignee: Transports Laprie-Biotrans, Merignac (FR)

( * ) Notice: Subject to any disclaimer, the term of this patent is extended or adjusted under 35 U.S.C. 154(b) by 0 days.

(21) Appl. No.: 09/743,246

(22) PCT Filed: Jul. 21, 1999

(86) PCT No.: PCT/FR99/01785

§ 371 (c)(1),
(2), (4) Date: Jan. 5, 2001

(87) PCT Pub. No.: WO00/05146

PCT Pub. Date: Feb. 3, 2000

(51) Int. Cl.[7] ..... A61B 17/06
(52) U.S. Cl. ..... 206/438; 206/570; 220/23.86
(58) Field of Search ..... 206/438, 526, 206/570, 587; 220/23.86; 62/60

(56) References Cited

U.S. PATENT DOCUMENTS

| | | | | |
|---|---|---|---|---|
| 3,971,231 A | * | 7/1976 | Derry | 62/388 |
| 4,470,264 A | | 9/1984 | Morris | |
| 4,782,942 A | * | 11/1988 | Ashley et al. | 206/5.1 |
| 5,011,018 A | * | 4/1991 | Keffeler | 206/532 |
| 5,201,867 A | * | 4/1993 | Morszeck | 206/316.2 |
| 5,579,941 A | * | 12/1996 | Romick | 220/23.86 |
| 5,931,304 A | * | 8/1999 | Hammond | 206/570 |
| 5,956,968 A | * | 9/1999 | Grabowski | 62/457.2 |

FOREIGN PATENT DOCUMENTS

| | | | |
|---|---|---|---|
| DE | 3804595 A1 | 2/1988 | B65D/81/10 |
| EP | 0 351 202 A2 | 7/1989 | B65D/25/10 |
| WO | WO 97/28064 | 8/1997 | B65D/81/18 |

OTHER PUBLICATIONS

International Preliminary Examination Report (in French) dated Oct. 24, 2000.
Notification of Transmission of International Preliminary Examination Report (in French) dated Oct. 24, 2000.
International Search Report (in French) dated Oct. 29, 1999.

* cited by examiner

*Primary Examiner*—Mickey Yu
*Assistant Examiner*—Jila M. Mohandesi
(74) *Attorney, Agent, or Firm*—Cohen, Pontani, Lieberman & Pavane

(57) ABSTRACT

The invention relates to a device for transporting bags containing blood, the device having firstly a container having a bottom (40), side walls (42, 44, 46, 48) that are parallel in pairs, and a lid (50); and secondly a plurality of envelopes (10), each envelope (10) being suitable for receiving one of said bags and having two main faces that are interconnected via two substantially parallel sides and via a bottom. Each side is provided with a fastening member (26, 28) extending over at least a fraction of the length of the side and including a rim-shaped fastening portion and a narrow coupling portion for connecting the fastening portion to the side of the envelope, the distance between the ends of the rims closer to the bottom of the envelope being greater than the distance between the opposite ends of the rims. The container is provided with pairs of mutually parallel slots (58) extending along the height of the container, each slot (58) being suitable for receiving the rim and the coupling portion of an envelope (10).

6 Claims, 2 Drawing Sheets

FIG.1
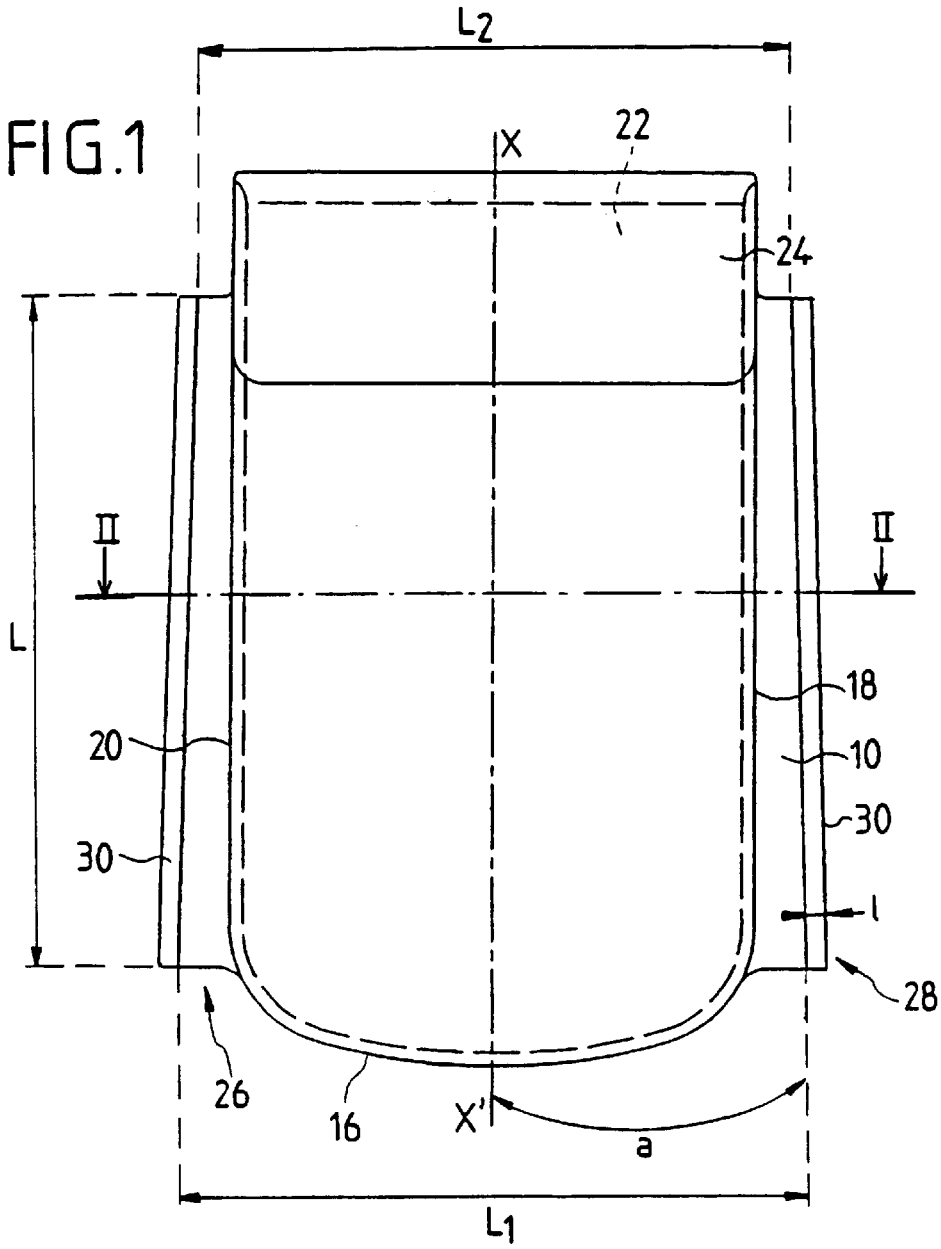
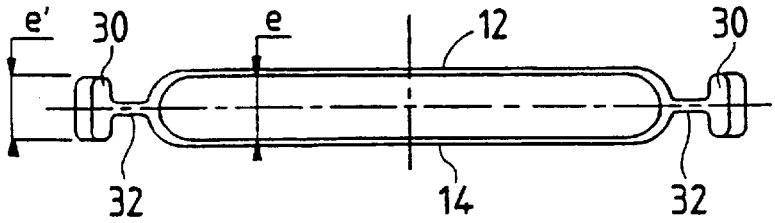
FIG.2

DEVICE FOR TRANSPORTING FRAGILE OBJECTS, AND IN PARTICULAR BLOOD BAGS

The present invention relates to a device for transporting fragile objects, and in particular blood bags.

More precisely, the invention relates to a device enabling fragile or delicate objects to be transported under the required safety conditions, and particularly, but not exclusively, it relates to transporting blood bags, bags of frozen plasma, receptacles containing physiological liquids, or indeed receptacles containing organs for transplanting.

It will be understood that to transport such objects, it is necessary to take special precautions to ensure that objects of this type are not spoiled during transport. The transport device should also make it possible in the event of a receptacle being ruptured to confine the liquid flowing out therefrom so as to avoid any problem of contamination.

Furthermore, during transport, it is necessary to maintain such objects at a regulated temperature so it is necessary to make provision for temperature-maintaining air to circulate between various objects.

Document U.S. Pat. No. 4,470,264 describes a device for transporting bags containing a liquid of blood or analogous type, which device comprises a container having a bottom, side walls that are parallel in pairs, and a lid, at least the bottom and the side walls being made of a thermally insulating structure.

An object of the present invention is to provide a device for transporting objects that are delicate or fragile, and in particular blood bags, the device improving security during transport in particular against risks associated with impacts, while nevertheless allowing good ventilation by air circulation.

To achieve this object, the invention provides a device for transporting fragile objects, and in particular blood bags or the like, the device comprising a container having a bottom, side walls that are parallel in pairs, and a lid, at least the bottom and the side walls being made of a thermally insulating structure, said device being characterized in that it further comprises:

- a plurality of envelopes, each envelope being suitable for receiving one of said bags, each envelope having two main faces interconnected via two substantially parallel sides and a bottom; each side being fitted with a fastening member extending over at least a fraction of the length of the side and comprising a fastening portion in the form of a rim and a coupling portion of narrower thickness for coupling the fastening portion to the side of the envelope, the distance between the ends of the rims closer to the bottom of the envelope being greater than the distance between the opposite ends of the rims;
- the container being provided with pairs of mutually parallel slots extending up the height of the container, each slot being suitable for receiving the rim and the coupling portion of an envelope.

It will be understood that the fragile object, e.g. the blood bag, is placed inside the envelope. The envelope itself is connected to the box proper via fixing systems which absorb shock in the event of a fall or in the event of shock being applied to the container itself. In addition, because of the fixing system, the envelopes and thus the objects they contain are maintained in a vertical position and the relative positioning between the various envelopes, and thus the blood bags, is accurately maintained regardless of the forces to which the box and thus the envelopes may be subjected.

In a preferred embodiment, the envelopes are made of an elastomer material and, in each pair, the slots suitable for receiving the rims of the fastening elements spread apart from each other on going towards the bottom of the container, whereby a traction force is applied to the envelope when it is engaged in the slots.

It will be understood that by means of these particular dispositions, the resilient link between the container and the envelopes is further reinforced and any shocks that might be applied to the container are better absorbed by the envelopes, e.g. containing blood bags. Furthermore, the traction force applies better clamping of the object or the blood bag inside the envelope, thus further improving retention of the object in the envelope.

Other characteristics and advantages of the invention will appear better on reading the following description of a preferred embodiment of the invention given by way of non-limiting example. The description refers to the accompanying figures, in which:

FIG. 1 is an elevation view of an envelope;

FIG. 2 is a section view of the envelope on line II—II of FIG.1;

Figure 3:
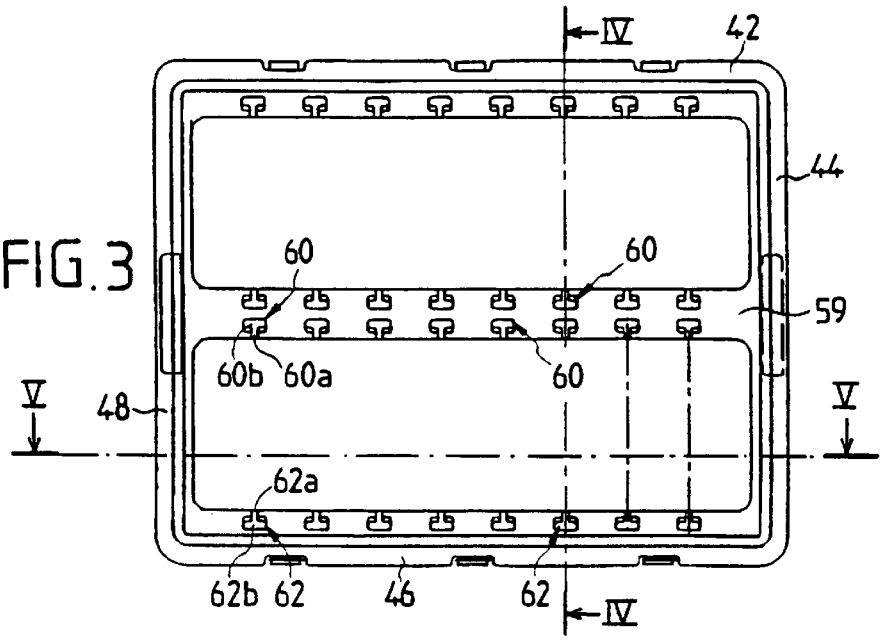
FIG. 3 is a plan view of the container before the envelopes are put into place.

As already mentioned, the transport device comprises firstly a container and secondly a plurality of envelopes that are placed in the container, each envelope receiving a fragile object or more particularly a bag of blood or of an analogous liquid. With reference initially to FIGS. 1 and 2, a preferred embodiment of an envelope is described.

The envelope is made of a silicone type elastomer material or EPDM capable of being shaped by molding. The envelope 10 has two main faces 12 and 14 that are generally rectangular in shape, being connected together at their periphery to constitute a bottom 16 and two sides 18 and 20. At their top end, the two faces 12 and 14 define an opening 22 which can be closed by a flap 24. During manufacture, the envelope 10 is made in such a manner that at rest the envelope presents a certain thickness e.

In order to enable envelopes to be fixed in the container as explained below, the envelope 10 is provided with fastening assemblies 26 and 28. Each fastening assembly is fixed to one of the sides 18 or 20 of the envelope, or more particularly is integrally molded together with the envelope itself. The fastening elements 26 and 28 extend over a length L which represents a significant portion of the length of the envelope 10. As shown better in FIG. 2, each fastening assembly 26 or 28 has a rim-forming portion 30 and a thin coupling-forming portion 32. The rim-forming portion 30 can be substantially rectangular in right section as shown in FIG. 2, however this portion could also be substantially circular in shape.

As shown more clearly in FIG. 1, the rim-forming portions 30 of the fastening assemblies 26 and 28 are not parallel to each other, but diverge going towards the bottom 16 of the envelope. Furthermore, they are of constant width l. In other words, the distance L1 between the bottom ends of the rims 30 is greater than the distance L2 between the top ends of the rims 30. Relative to the vertical axis XX' of the envelope, the rims thus form an angle a which preferably lies in the range 3° to 10°.

Figure 4:
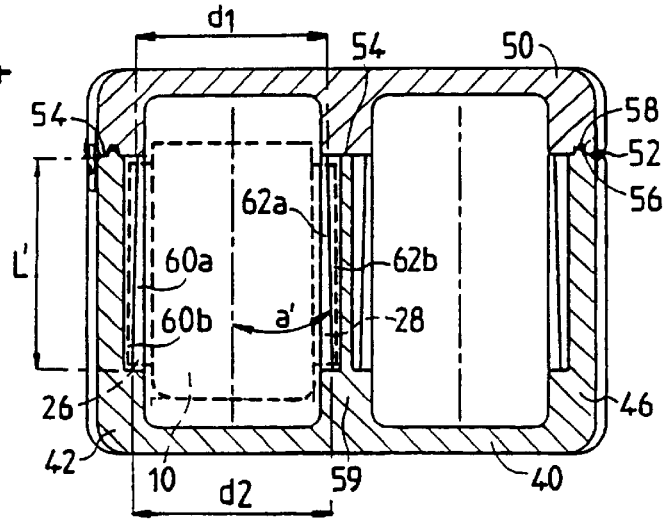
FIG. 4 is a view in elevation and in section on line IV—IV of FIG. 3.
Figure 5:
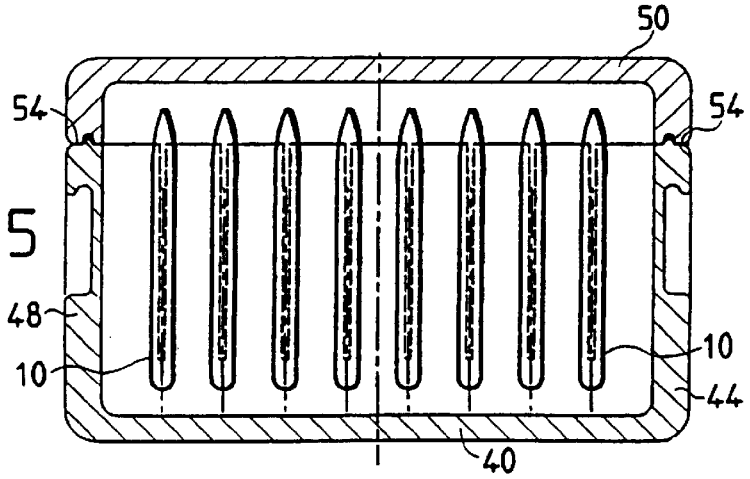
FIG. 5 is a view in elevation and in section on line V—V of FIG. 3, the envelopes being in place in the container.

With reference now to FIGS. 3 to 5, a preferred embodiment of the container is described. The container is substantially in the form of a rectangular parallelepiped. It has a bottom 40 and four side walls 42, 44, 46, and 48 which are parallel in pairs. The container is finished off by a lid 50 which is hinged about hinges 52. In the top edges 54 of the side walls, there is a tongue 56 suitable for co-operating with a groove 58 formed in the edge of the lid 50 so as to provide sealing and thermal insulation between the container proper and the lid 50. Inside the container, there is preferably a vertical partition 59 parallel to side walls 42 and 46.

To provide thermal insulation of objects placed in envelopes inside the container, the walls of the container are preferably made of a material or of a structure that presents thermal insulation properties. Such structures can present various architectures.

In order to enable each envelope to be fixed inside the container, pairs of slots 60 and 62 are provided in the inside faces of the side walls 42 and 46 and in the faces of the partition 59. Each pair of slots lies in a plane parallel to the side walls 44 and 48 so that these pairs of slots define planes that are mutually parallel and substantially equidistant. Each slot 60 or 62 has a portion 62*a*, 60*a* in the form of a slit for allowing the coupling portion 32 of each fastening assembly of an envelope to pass through and opening out into the inside of the container, and also a portion 62*b*, 60*b* of greater width suitable for receiving the rims 30 of the envelopes. In right section, the portions 62*b*, 60*b* are of a shape that matches that of the rims. The slots 60 and 62 open out into the top edges 54 of the side walls or of the partitions 59 and they extend over a height L' substantially equal to the length L of the fastening elements of the envelopes. As shown more clearly in FIG. 4, for each slot 60 or 62 the narrow portion 60*a* is preferably of a width that increases going from the top end of the slot towards its bottom end. Thus, these portions 60*a*, 62*a* form an angle a' with the vertical, said angle a' preferably being equal to the angle a formed by the rims of the fastening assemblies of the envelopes. Nevertheless, the lengths d1 and d2 between the top and bottom ends respectively of the portions 60*a* and 62*a* are slightly greater than the distances L2 and L1 respectively between the corresponding ends of the rims 30.

By means of these characteristics, it will be understood that when the lid 50 is raised, it is easy to engage the fastening elements 26 and 28 of an envelope in a pair of slots 60 and 62, and that by engaging the envelopes, given the presence of the angles a and a' and the respective dimensions d1, d2 and L2, L1, a traction effect is exerted on the envelope over substantially its entire length, with this effect increasing as the envelope becomes engaged progressively more deeply. This traction force provides a resilient link between the container and the envelope, thus absorbing shocks that might be applied to the container and making it possible to exert a certain amount of pressure on the object placed inside each envelope, thereby holding the object firmly within the envelope. Nevertheless, it will be understood that it would not go beyond the invention if the distances d1 and d2 were equal.

In addition, the rims could be initially separate and added to an envelope proper. Under such circumstances, they could be made of nylon to reduce friction.

Finally, it should be added that the envelopes perform two functions. Firstly, while mounted in the container, they serve to hold blood bags resiliently under traction. Secondly, each envelope provides individual protection for the blood bag it contains for the purpose of transporting the bag with the envelope extracted from the container.

What is claimed is:

1. A device for transporting bags containing a liquid of blood or analogous type, said device comprising:

a container having a bottom, side walls that are parallel in pairs, and a lid, at least said bottom and said side walls being made of a thermally insulating structure, a plurality of envelopes, each envelope being suitable for receiving one of said bags, each envelope having two main faces interconnected via two substantially parallel sides and a plurality of fastening members, each fastening member being connected to a side of an envelope and extending over at least a fraction of the length of said side and comprising a fastening portion in the form of a rim having two ends and a coupling portion of narrower thickness for coupling said fastening portion to said side of the envelope, the distance between the rims of two fastening members connected to an envelope closer to the bottom of the envelope being greater than the distance between the opposite rims;

said container being provided with pairs of mutually parallel slots extending up the height of the container, each slot being suitable for receiving the rim and the coupling portion of an envelope.

2. A transport device according to claim 1, wherein said container further comprises at least one internal partition parallel to two of the side walls and said slots in any given pair are made respectively in one of said walls and in, the internal partition.

3. A transport device according to claim 2, wherein the pairs of slots are disposed in planes that are parallel to two opposite walls of the container.

4. A transport device according to claim 1, wherein said envelopes are made of an elastomer material and, in each pair of slots, the slot portions suitable for receiving the rims of the fastening elements spread apart from each other on going towards the bottom of the container, whereby a traction force is applied to the envelope when said envelope is engaged in the slots.

5. A transport device according to claim 1 wherein each envelope has a flap for closing its opening remote from its bottom.

6. A transport device according to claim 2 wherein said envelopes are made of an elastomer material and, in each pair of slots, the slot portions suitable for receiving the rims of the fastening elements spread apart from each other on going towards the bottom of the container, whereby a traction force is applied to the envelope when said envelope is engaged in the slots.

* * * * *